US006406028B1

(12) United States Patent
Kannan

(10) Patent No.: US 6,406,028 B1
(45) Date of Patent: Jun. 18, 2002

(54) SEAL STACK

(75) Inventor: Dhani Kannan, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/498,243

(22) Filed: Feb. 3, 2000

Related U.S. Application Data

(60) Provisional application No. 60/118,890, filed on Feb. 5, 1999.

(51) Int. Cl.[7] ..... F16J 15/34

(52) U.S. Cl. ..... 277/361; 277/336; 277/337; 277/338; 277/339; 277/342

(58) Field of Search ..... 277/336, 337, 277/338, 339, 342

(56) References Cited

U.S. PATENT DOCUMENTS

| | | | | |
|---|---|---|---|---|
| 4,234,197 A | | 11/1980 | Amancharla | |
| 4,811,959 A | * | 3/1989 | Bullard et al. | 277/124 |
| 5,306,021 A | | 4/1994 | Morvant | |
| 5,309,993 A | | 5/1994 | Coon et al. | |

* cited by examiner

*Primary Examiner*—Anthony Knight
*Assistant Examiner*—Matthew E. Rodgers
(74) *Attorney, Agent, or Firm*—Trop, Pruner & Hu P.C.

(57) ABSTRACT

A seal stack includes one or more first seals that are adapted to seal in at least a first range of temperatures. The seal stack also includes a second seal that is adjacent to at least one of the first seals. The second seal is adapted to seal in at least a lower range of temperatures than the first range of temperatures.

18 Claims, 5 Drawing Sheets

SEAL STACK

This application claims priority under 35 U.S.C. §119 to U.S. Provisional Application Ser. No. 60/118,890, entitled, "SEAL STACK," filed on Feb. 5, 1999.

BACKGROUND

The invention relates to a seal stack.

Referring to FIG. 1, a downhole tool 14 may be used to perform such functions as measuring performance of a subterranean well 10 and controlling production from the well 10. As examples, the tool 14 may be part of a test string 12, part of a drill string, connected to a wireline, or connected to a slickline.

In the course of its operation, the tool 14 may be subject to a large range of temperatures and a large range of pressures. For example, the temperatures that the tool 14 may experience may vary from approximately 60° Fahrenheit (F.) to approximately 500° F., and the pressures may vary from approximately a few pounds per square inch (psi) to approximately 30,000 psi. These variations, in turn, may affect the performance of seals of the tool 14. As an example, referring to FIG. 2, the tool 14 may include a mandrel 22 that may move in response to pressure differences to actuate a downhole valve (not shown), for example. More particularly, the mandrel 22 may have a piston head surface 24 that is contact with fluid in one chamber 26 and another piston head surface 20 that is contact with fluid in another chamber 27. In this manner, the pressure differential between the two chambers 26 and 27 influences movement of the mandrel 22.

To isolate the two chambers 26 and 27 from each other, the tool 14 may include an annular seal 30 (a seal stack, for example) that is located in an annular cavity of the mandrel 22 and between the two piston head surfaces 20 and 24. The type of seal 30 that is used may be selected based on the expected downhole temperatures and pressures. However, the tool 14 may be used in applications that cause the tool 14 to experience a wide range of temperatures and pressures. For example, oil and gas exploration is currently advancing into the traditionally deeper and harder to reach areas in which pressures may be near 20,000 psi, and the temperature may be over 400° F. Furthermore, operation of the tool 14 may increase the pressure to near 30,000 psi. Therefore, the seal 30 may be required to operate over a wide range of conditions.

Thus, there is a continuing need for a seal that addresses one or more of the problems stated above.

SUMMARY

In an embodiment of the invention, a seal stack includes one or more first seals that are adapted to seal in at least a first range of temperatures. The seal stack also includes a second seal that is adjacent to at least one of the first seals. The second seal is adapted to seal in at least a lower range of temperatures than the first range of temperatures.

Advantages and other features of the invention will become apparent from the following description, drawing and claims.

DETAILED DESCRIPTION

Figure 3:
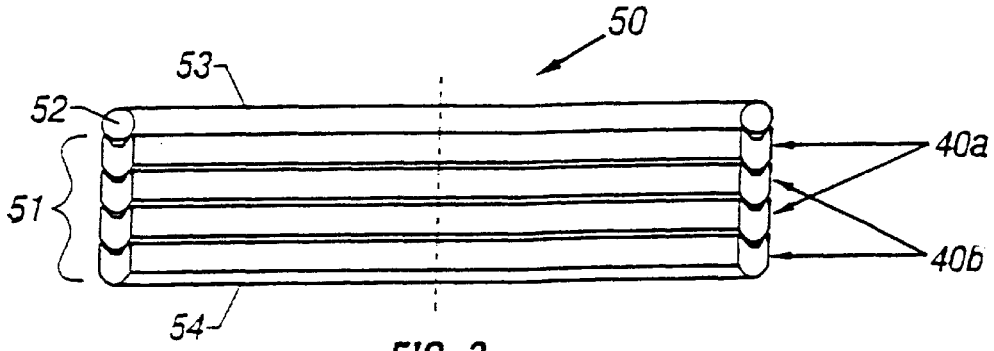
FIGS. 3 and 7 are cross-sectional views of seal stacks according to embodiments of the invention.
Figure 6:
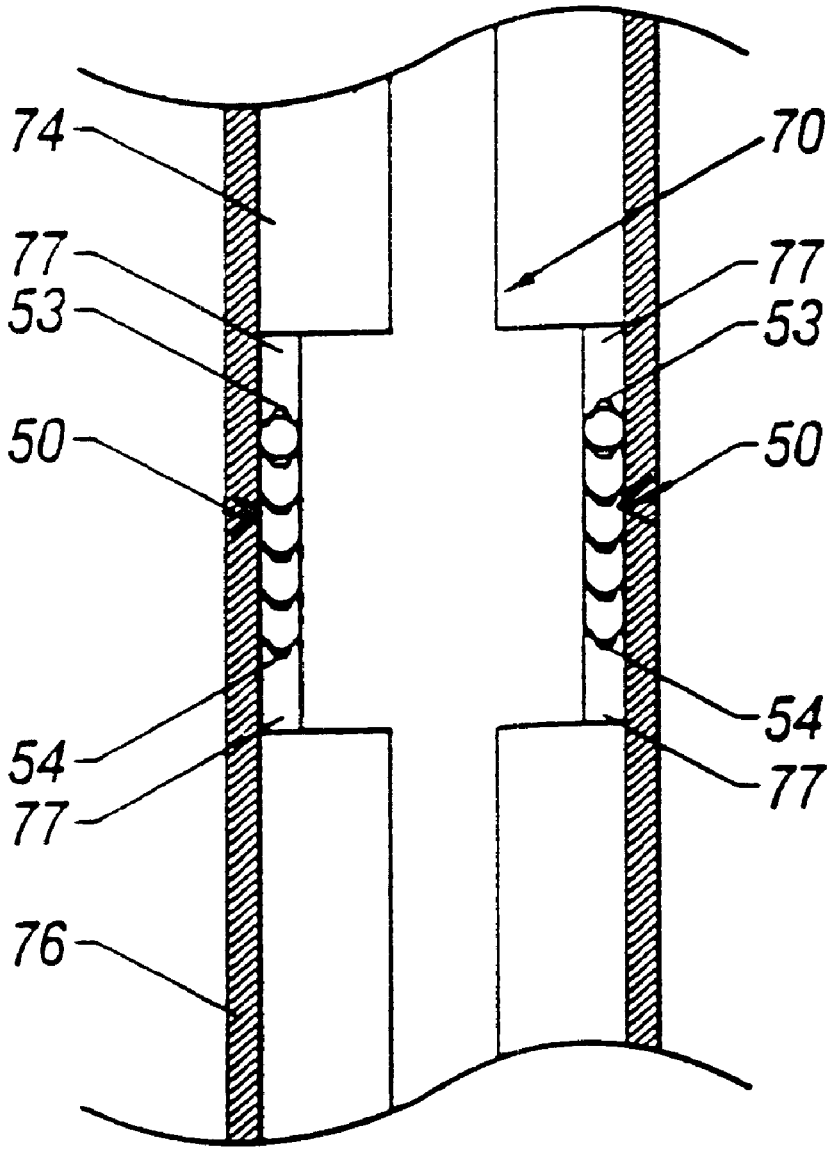
FIG. 6 is a schematic diagram of a portion of a downhole tool according to an embodiment of the invention.

Referring to FIG. 3, an embodiment 50 of an unidirectional seal stack in accordance with the invention includes a stack 51 of chevrons, or v-rings 40 (v-rings 40*a* and 40*b*, as examples), and a seal ring, such as an O-ring 52, that cooperate together to form a seal both at low temperatures and low pressures and also at high temperatures and high pressures. As an example, the seal stack 50 may be used in conjunction with a mandrel 70 to form a seal between two chambers 74 and 76 of a downhole tool, as depicted in FIG. 6. The chamber 74 may include a fluid (fluid from an annulus of a well, for example) that exerts a higher pressure on the mandrel 70 than a pressure (an atmospheric pressure, for example) that is exerted by a fluid (air, for example) that is present in the chamber 76. The seal stack 50 may be used in either static or dynamic conditions.

The O-ring 52 may be adapted to form the most effective seal at low temperatures and low pressure differentials. Conversely, the stack 51 of v-rings 40 is adapted to form an effective seal at higher temperatures and higher pressure differentials, as described below. Therefore, due to the combination of the stack 51 of v-rings 40 and the O-ring 52, a large range of pressure differentials and temperatures may be accommodated.

Figure 4:
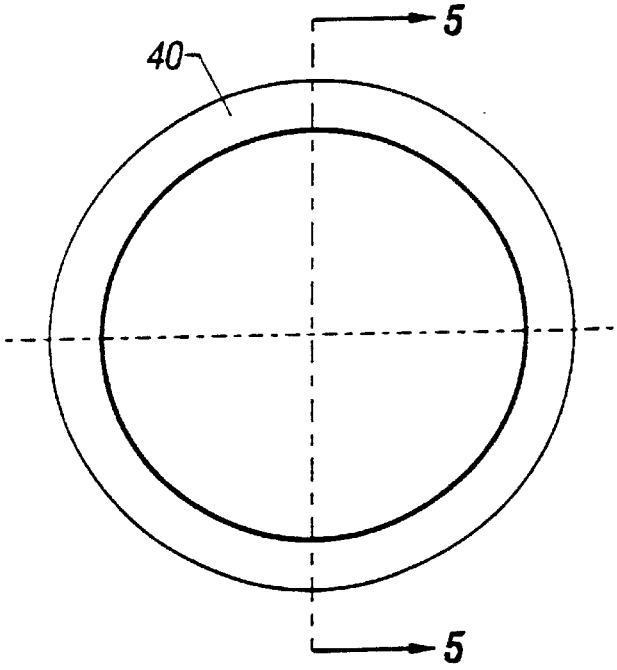
FIG. 4 is a top view of a v-ring according to an embodiment of the invention.
Figure 5:
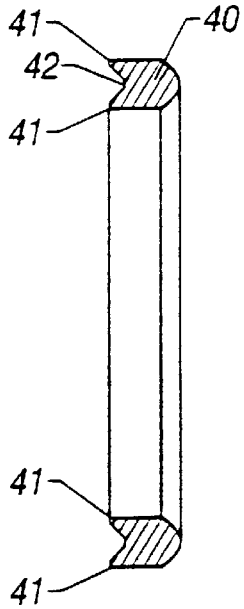
FIG. 5 is a cross-sectional view of the v-ring taken along line 5—5 of FIG. 4.

Referring to FIGS. 4 and 5, each v-ring 40 may have a circular groove 42 to mate with the seal placed in the groove and energize the v-ring 40 to radially expand. The groove 42 may have a v-shaped cross-section, as depicted in FIG. 5. In this manner, two v-rings 40 (as an example) may be stacked together by allowing the upper v-ring 40 to rest in the groove 42 of the lower v-ring 40. Due to the v-shaped cross section of the groove 42, flanges 41 of the groove 42 may conform to irregularities in the surface to which the seal is formed.

Referring back to FIG. 3, in some embodiments, the stack 51 may include primary sealing v-rings 40*a* and secondary sealing v-rings 40*b*. The primary sealing v-rings 40*a* may be softer and more pliable than the harder secondary sealing v-rings 40*b*, a condition that permits the primary sealing v-rings 40*a* to conform to surface irregularities. The secondary sealing v-rings 40*b*, in turn, are more inflexible, a feature that permits the secondary sealing v-rings 40*b* to provide mechanical support for the primary sealing v-rings 40*a* to prevent extrusion.

In some embodiments, each primary sealing v-ring 40*a* may be stacked on top of a secondary sealing v-ring 40*b* to form an interleaved arrangement of primary 40*a* and secondary 40*b* sealing v-rings, as depicted in FIG. 3. To function properly, the seal stack 50 must be oriented in the proper direction between the low and high pressure chambers. In this manner, for the seal stack 50 the groove 42 of each v-ring 40 is open toward an end 53 of the seal stack 50 that receives the largest forces (as compared to the other end 54), i.e., the end 53 of the seal stack 50 is subject to the largest pressure and thus, seals the highest pressure chamber. The O-ring 52 may rest in the groove 42 of the v-ring 40*a* that is closest to the end 53 of the stack 51.

As an example, in some embodiments, the primary sealing rings 40*a* may be made out of Avalon 87 from Greene Tweed & Co of Houston, Tex. However, the primary sealing rings 40*a* may be made out of other materials in other embodiments. The secondary sealing rings may be made out of Virgin PEEK material, as an example. The O-ring 51 may be made from a thermoplastic or an elastomeric material, as examples. As more specific examples, the O-ring 51 may be made from Nitrile, Viton, Kalrez or other materials that seal at low temperatures. However, the O-ring 51 may be made from materials, such as Kalrez, that seal at both low and high temperatures. In some embodiments, the v-rings 40 and the O-ring 52 may be lubricated using high temperature gold grease, STP engine oil or graphite alcohol, as just a few examples. The seal stack 50 may be used in a relatively large (compared to conventional seal stacks) radial extrusion gap of, for example, approximately 0.006 to 0.009 inches.

The seal stack 50 may be used in a variety of applications, such as to seal a borehole or to seal chambers associated with a mandrel. When used with the mandrel 70 (see FIG. 6), the stack 50 may be supported on both ends 53 and 54 by annular metal adapters 77 that may be made out of, for example, K-Monel material. In some embodiments, a clearance, such as approximately 0.100 inches (for example), may be allowed between the assembly including the adapters 77 and the stack 50 and an annular groove (not shown) in which this assembly is seated to allow for thermal expansion. The portion of the mandrel 70 that receives the seal stack 50 may be machined to approximately a 16 rms surface finish (for example), and this portion of the mandrel 70 may radially extend to within approximately 0.002" (for example) concentricity of the inner diameter of the seal stack 50.

As noted above, the seal stack 50 is adapted to form a seal when a higher pressure is applied to the end 53 than the pressure that is applied to the other end 54. However, in some applications, a pressure differential (defined in a specific direction) across the seal stack may vary between positive and negative values. For example, the fluid in the chamber 74 may be a production fluid, and the fluid in the chamber 76 may be fluid from the annulus of the well. As a result, due to the different operating depths and states of the well, the pressure exerted by the production fluid may be greater or less than the pressure exerted by the fluid in the annulus.

Figure 7:
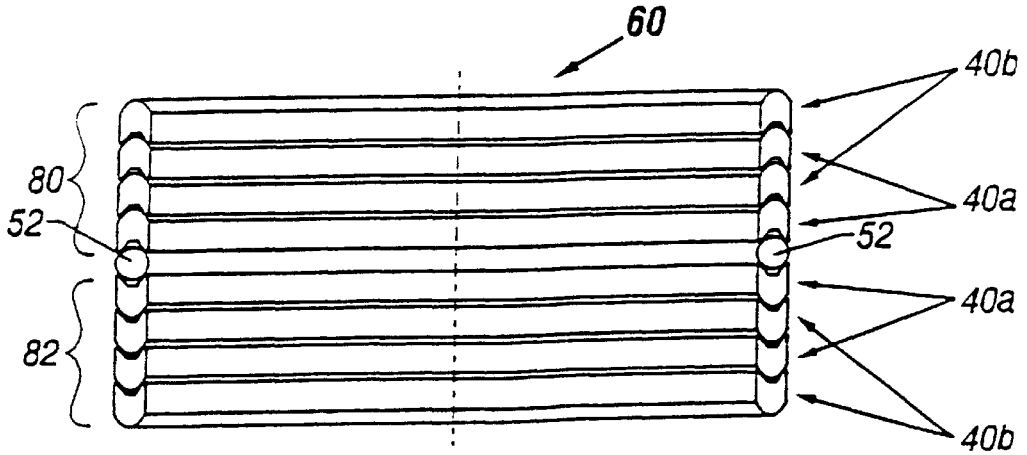

Referring to FIG. 7, to accommodate potential reversals in pressure differentials, some embodiments may include a bidirectional seal stack 60, an arrangement that includes two unidirectional v-ring stacks 80 and 82 and an O-ring 52 that is sandwiched in between. More particularly, one stack 80 may be oriented to accept a positive pressure differential in one direction, i.e., the grooves 42 of the v-rings 40 of the stack 80 may be aligned to accept a pressure differential in a particular direction. The other stack 82 may be oriented to accept a positive pressure differential in the opposite direction, i.e., the grooves 42 of the v-rings 40 of the stack 82 may be aligned to accept a pressure differential in the opposite direction. Thus, both unidirectional stacks 80 and 82 are opposed to each other. The O-ring 52 rests in grooves 42 of both stacks 80 and 82. As a result of this arrangement, regardless of whether the pressure differential (defined in a specific direction) is positive or negative, the bi-directional seal stack 60 forms a sufficient seal. In some embodiments, when used with a mandrel 70, a clearance of approximately 0.175 inches may exist between the assembly that includes the stack 60 and the metal adapters 77 in an annular groove (not shown) in which the assembly is seated to allow for thermal expansion. The seal stack 60 may be used in either static or dynamic conditions.

Figure 1:
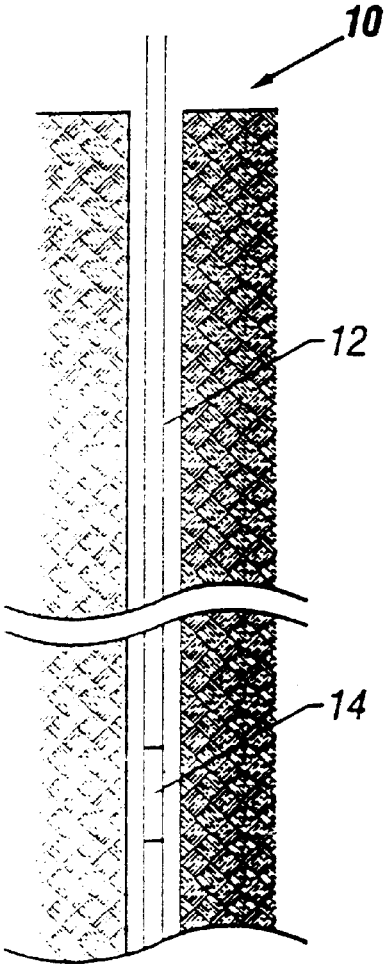
FIG. 1 (Prior Art)
FIG. 1 is a schematic diagram of a subterranean well of the prior art.
Figure 2:
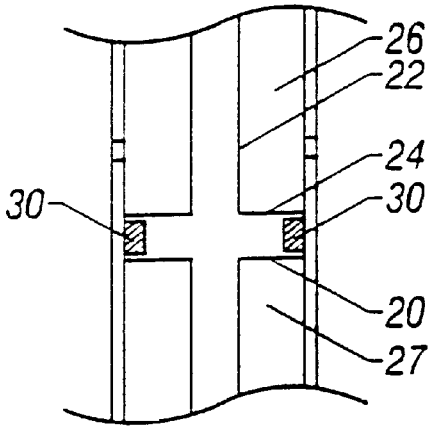
FIG. 2 (Prior Art)
FIG. 2 is a schematic diagram of a portion of an exemplary downhole tool that is depicted in FIG. 1.
Figure 8:
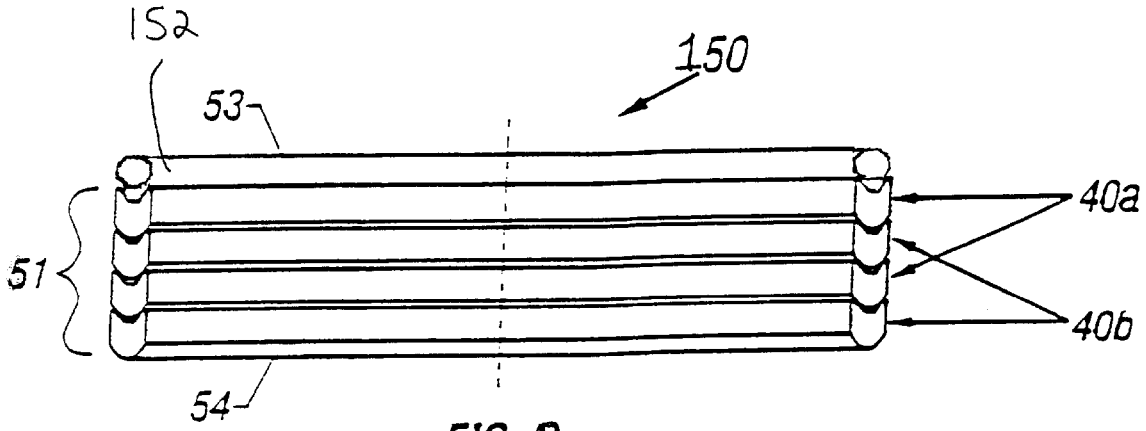
FIG. 8 is a cross-sectional view of a seal stack according to another embodiment of the invention.
Figure 9:
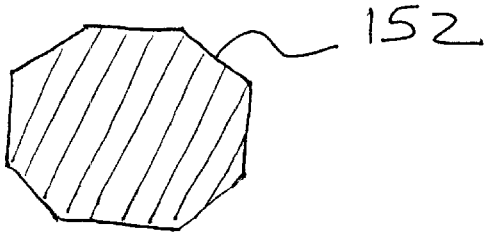
FIG. 9 is a more detailed view of the cross-section of a seal ring that is depicted in FIG. 8.

Other embodiments are within the scope of the following claims. For example, in some embodiments of the invention, the O-ring 52 may not reside in the groove 42 of an adjacent v-ring 40, but, instead the O-ring 52 may be separated by a spacer ring from the adjacent v-ring. Thus, in these embodiments, the O-ring 52 may be adjacent to the groove 42 and not contact the v-ring 40. As another example of other embodiments of the invention, the unidirectional seal stack 50 is shown with four v-rings 40. However, the unidirectional seal stack may include more or less than four v-rings 40. Similarly, the bi-directional seal stack may include more or less than eight v-rings 40. As yet another example of additional embodiments, the O-ring 52 (having a circular cross-section) may be replaced by an elastomer ring that does not have a circular cross-section. For example, referring to FIG. 8, in some embodiments of the invention, a unidirectional seal stack 150 may be used in place of the unidirectional seal stack 50 (see FIG. 1). The seal stack 150 is similar in design to the seal stack 50 except that the O-ring 52 of the seal stack 50 has been replaced by an elastomer ring 152. As shown in greater detail in FIG. 9, the elastomer ring 152 may, for example, have a hexagonal cross-sectional, although other cross-sections may be used in other embodiments of the invention.

While the invention has been disclosed with respect to a limited number of embodiments, those skilled in the art, having the benefit of this disclosure will appreciate numerous modifications and variations therefrom. It is intended that the appended claims cover all such modifications and variations as fall within the true spirit and scope of the invention.

What is claimed is:

1. A seal stack comprising:

first v-ring seals adapted to seal in at least a first range of temperatures, the first v-ring seals comprising at least one primary v-ring seal and at least one secondary v-ring seal, at least one of the secondary v-ring seals being substantially less flexible than any of the primary v-ring seals to support the primary v-ring seals; and a second seal adjacent to one of the first v-ring seals, the second seal adapted to seal in at least a lower range of temperatures than the first range of temperatures.

2. The seal stack of claim 1, wherein the second seal contacts at least one of the first v-ring seals.

3. The seal stack of claim 1, wherein the second seal comprises an elastomer material.

4. The seal stack of claim 1, wherein the second seal comprises a thermoplastic material.

5. The seal stack of claim 1, wherein the second seal comprises an O-ring.

6. The seal stack of claim 1, wherein the second seal has a cross-section that is non-circular.

7. The seal stack of claim 1, wherein the first v-ring seals are arranged in a stack.

8. A seal stack comprising:

first v-ring seals adapted to seal in a first range of temperatures, the first v-ring seals having grooves aligned in a first direction and comprising at least one primary v-ring seal and at least one secondary v-ring seal, at least one of the secondary v-ring seals being substantially less flexible than any of the primary v-ring seals to support the primary v-ring seals;

second seals adapted to seal in the first range of temperatures, the second seals having grooves aligned in a second direction substantially opposed to the first direction; and a third seal located between one of the grooves of the first v-ring seals and one of the grooves of the second seals, the third seal being adapted to seal in a lower range of temperatures than the first range.

9. The seal stack of claim 8, wherein the third seal contacts at least one of the first v-ring seals and second seals.

10. The seal stack of claim 8, wherein the third seal comprises an elastomer material.

11. The seal stack of claim 8, wherein the third seal comprises a thermoplastic material.

12. The seal stack of claim 8, wherein the third seal comprises an O-ring.

13. The seal stack of claim 8, wherein the third seal has a cross-section that is non-circular.

14. The seal stack of claim 8, wherein the third seal is adapted to perform in a high range of pressures and perform in a substantially lower range of pressures, and at least one of the first v-ring seals and second seals is adapted to perform in the high range and not in the lower range.

15. A method comprising:

stacking first v-ring seals together to form a first seal assembly that seals in at least a first range of temperatures, the first v-ring seals comprising at least one primary v-ring seal and at least one secondary v-ring seal, at least one of the secondary v-ring seals being substantially less flexible than any of the primary v-ring seals to support the primary v-ring seals; and positioning a second seal adjacent to the first v-ring seals, the second seal adapted to seal in at least a lower range of temperatures than the first range of temperatures.

16. The method of claim 15 wherein the second seal has a cross-section that is non-circular.

17. The method of claim 15, further comprising:

placing the second seal in a groove of the first v-ring seals.

18. The method of claim 15, further comprising:

selecting a material composition for the second seal, the material composition of the second seal being adapted to perform in a low range of pressures and perform in a substantially higher range of pressures, and selecting a material composition for each of the first v-ring seals, the material composition of the first v-ring seals being adapted to perform in the higher range of pressures and not in the low range.

* * * * *